US009692114B2

(12) United States Patent
Zhao et al.

(10) Patent No.: US 9,692,114 B2
(45) Date of Patent: Jun. 27, 2017

(54) COMPACT, RUGGED, ENVIRONMENTALLY-SEALED, ELECTRICALLY NON-CONDUCTIVE, ANTENNA RADOME FOR AN RFID READER AND METHOD OF INSTALLING AN ANTENNA IN THE RADOME

(71) Applicant: SYMBOL TECHNOLOGIES, LLC, Lincolnshire, IL (US)

(72) Inventors: Wancheng Zhao, Saint James, NY (US); Joseph D. Giordano, Bayville, NY (US); Roland Wing Fai Lee, Jericho, NY (US); Heng Zhang, Setauket, NY (US)

(73) Assignee: Symbol Technologies, LLC, Holtsville, NY (US)

( * ) Notice: Subject to any disclaimer, the term of this patent is extended or adjusted under 35 U.S.C. 154(b) by 0 days.

(21) Appl. No.: 14/731,619

(22) Filed: Jun. 5, 2015

(65) Prior Publication Data

US 2016/0359223 A1 Dec. 8, 2016

(51) Int. Cl.

| | |
|---|---|
| ***H01Q 1/42*** | (2006.01) |
| ***H01Q 1/22*** | (2006.01) |
| ***H01Q 9/16*** | (2006.01) |

(52) U.S. Cl.

CPC ..... *H01Q 1/42* (2013.01); *H01Q 1/2216* (2013.01); *H01Q 9/16* (2013.01)

(58) Field of Classification Search

CPC ..... H01Q 1/42; H01Q 1/2216
USPC ..... 343/872, 846, 700 MS
See application file for complete search history.

(56) References Cited

U.S. PATENT DOCUMENTS

| | | | | |
|---|---|---|---|---|
| 2008/0007409 | A1* | 1/2008 | Ferry | B29C 43/222 340/572.1 |
| 2010/0309089 | A1* | 12/2010 | Collinson | H01Q 1/42 343/872 |
| 2012/0119975 | A1* | 5/2012 | Lee | H01Q 1/2208 343/905 |
| 2015/0255873 | A1* | 9/2015 | Chan | H01Q 9/285 343/806 |
| 2015/0295334 | A1* | 10/2015 | Mizoguchi | H01R 12/79 439/626 |

* cited by examiner

*Primary Examiner* — Peguy Jean Pierre

(57) ABSTRACT

A compact, rugged, environmentally-sealed, electrically non-conductive, antenna radome protects an antenna of a handheld radio frequency (RF) identification (RFID) reader operative for scanning RFID tags. A rear housing is directly connected to a front housing, each constituted of an electrically non-conductive material. A support structure in the housings supports the antenna to enable RF signals to be transmitted or received by the antenna forwardly through the housings during scanning without being detuned by electrically conductive materials and electrically conductive fasteners located forwardly of the antenna. A seal environmentally seals the antenna inside the housings.

19 Claims, 8 Drawing Sheets

COMPACT, RUGGED, ENVIRONMENTALLY-SEALED, ELECTRICALLY NON-CONDUCTIVE, ANTENNA RADOME FOR AN RFID READER AND METHOD OF INSTALLING AN ANTENNA IN THE RADOME

BACKGROUND OF THE INVENTION

The present disclosure relates generally to a compact, rugged, environmentally-sealed, electrically non-conductive, antenna radome for protecting an antenna operative for transmitting or receiving electromagnetic waves, and to a method of installing the antenna in the radome, and, more particularly, to using such an antenna radome with a radio frequency (RF) identification (RFID) reader, especially one configured for handheld, mobile use, and operative for scanning RFID tags associated with items contained in a controlled area, advantageously for inventory control of the RFID-tagged items.

RFID systems are well known and are commonly utilized for item tracking, item identification, and inventory control in manufacturing, warehouse, and retail environments. Briefly, an RFID system includes two primary components: a reader (also known as an interrogator), and a tag (also known as a transponder). The tag is a miniature device associated with an item to be monitored and is capable of responding, via a tag antenna, to an electromagnetic wave wirelessly propagated by a reader antenna of the reader. The tag responsively generates and wirelessly propagates a return electromagnetic wave back to the reader antenna. The return electromagnetic wave is modulated in a manner that conveys identification data (also known as a payload) from the tag back to the reader. The identification data can then be stored, processed, displayed, or transmitted by the reader as needed. The return electromagnetic wave can also be used to determine the true bearing and location of the tag in a controlled area.

The reader antenna is typically contained in, and protected by, a radome. Yet, the known radomes for handheld readers have several drawbacks. For example, the design of the known radomes is typically taken from the radome designs for fixed readers, which are relatively large, heavy, costly and obtrusive, and therefore largely impractical for handheld reader use where compact, light, and inexpensive considerations are more important for widespread adoption. In addition, the known radomes for handheld readers are not so structurally strong as to well resist strong impacts, and it is known for housing parts of the radomes to separate when dropped to the floor, or subjected to like abuse. Further, the known radomes for handheld readers are not so weatherproof, and typically expose their antennas to moisture, air, dust, and like contaminants in the environment over time and prolonged use. Also, the known radomes typically use electrically-conductive, metal fasteners in front of their antennas, i.e., forwardly of antenna keep-out planes, to hold their housing parts together, and such metal fasteners can detune their antennas, especially when they are located close to the antennas, as would be required for use with compact, handheld readers.

Accordingly, there remains a need for an antenna radome that is compact, rugged, environmentally-sealed, electrically non-conductive, for use with a handheld RFID reader for scanning RFID tags associated with items located in a controlled area, especially for inventory control of the RFID-tagged items, as well as to a method of installing an antenna in a radome.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
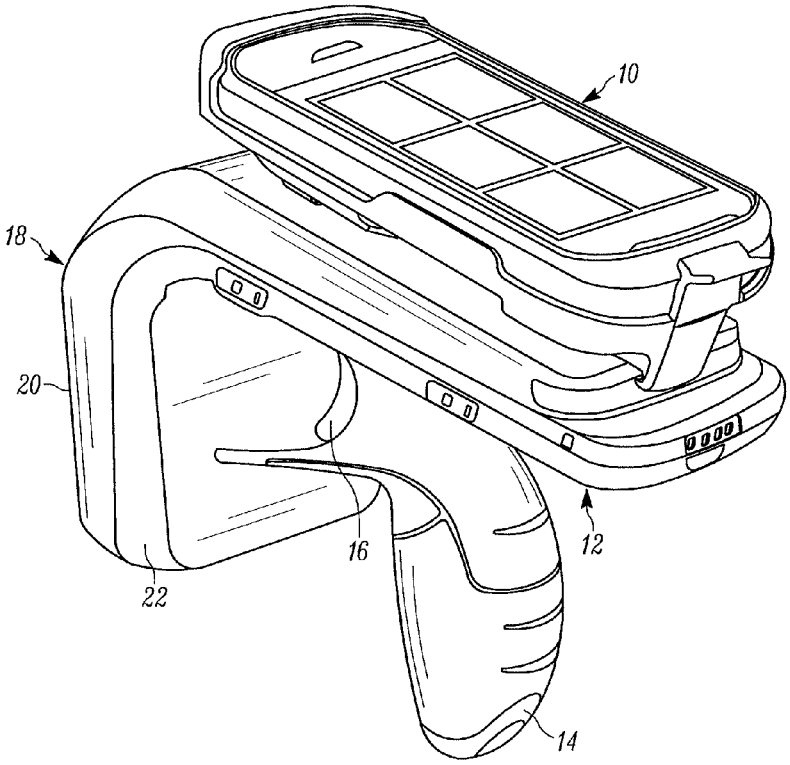
FIG. 1 is a perspective view of a handheld RFID reader connected to an antenna radome in accordance with the present disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The structural and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One aspect of this disclosure relates to an antenna radome for protecting an antenna of a radio frequency (RF) identification (RFID) reader operative for scanning RFID tags. Advantageously, the RFID reader is a handheld unit whose operating band of frequencies lies in a frequency range on the order of 902-928 MHz. This designated range is not intended to limit the invention disclosed herein, because other frequency ranges are also contemplated.

The radome includes a rear housing and a front housing, each constituted of an electrically non-conductive material, e.g., a synthetic plastic material. The front housing is directly connected to, and bounds an interior with, the rear housing. A support structure is located in the interior of the connected housings for supporting the antenna in the interior to enable RF signals to be transmitted or received by the antenna forwardly through the connected housings during scanning without being detuned by electrically conductive materials and electrically conductive fasteners located forwardly of the antenna. A seal between the connected housings environmentally seals the antenna inside the connected housings.

In a preferred embodiment, one of the housings has a plurality of electrically non-conductive, female fasteners, and the other of the housings has a corresponding plurality of electrically non-conductive, male fasteners. The male fasteners are moved into the female fasteners in a first direction, and are then moved in a second direction different from the first direction to secure the housings together. The housings are locked together by additional fasteners, which, if constituted of electrically conductive materials, are located rearwardly of the antenna behind a virtual antenna keep-out plane.

A method of installing an antenna, in accordance with another aspect of this disclosure, in a radome for use with a radio frequency (RF) identification (RFID) reader operative for scanning RFID tags is performed by mounting the antenna in an interior between a rear housing and a front housing, each housing being constituted of an electrically non-conductive material; by directly connecting the housings together; by supporting the antenna in the interior to enable RF signals to be transmitted or received by the antenna forwardly through the connected housings during scanning without being detuned by electrically conductive materials and electrically conductive fasteners located forwardly of the antenna; and by environmentally sealing the antenna inside the connected housings.

Turning now to FIG. 1 of the drawings, reference numeral 10 generally identifies a handheld RFID reader for interrogating and reading RFID tags within its coverage range. As shown, the reader 10 may include a display, a keypad, a touch panel, other input/output elements, or the like. This particular embodiment of the RFID reader 10 is mounted on a gun-shaped sled 12 having a handle 14 to be gripped and held by a user, a trigger 16 to be manually actuated by the user to initiate reading, and a front-mounted radome 18 having a front housing 20 and a rear housing 22 for containing therein an antenna 30 (for example, see FIG. 8) that is naturally pointed toward, and forwardly faces, each intended target tag during normal handheld operation of the RFID reader 10. The antenna 30 forwardly transmits electromagnetic waves to each tag in its turn, and receives return electromagnetic waves from each tag, during operation.

For the sake of brevity, conventional techniques related to RFID data transmission, RFID system architecture, RF signal processing, and other functional aspects of RFID systems (and the individual operating components of such systems) are not described in detail herein, except to say that the RFID reader 10 conventionally includes, without limitation: an RF communication module coupled to, and driving, the antenna 30; a power supply (e.g., a battery pack); a processor; and a memory. The various operating components of the reader 10 are coupled together as needed to facilitate the delivery of operating power from the power supply, the transfer of data, the transfer of control signals and commands, and the like. The processor may be any general purpose microprocessor, controller, or microcontroller that is suitably configured to control the operation of the reader. In practice, the processor may execute one or more software applications that provide the desired functionality for the reader 10. The memory is capable of storing application software utilized by the processor and/or data captured by the reader 10 during operation. The RF communication module is suitably configured to process RF signals associated with the operation of the reader 10, and to otherwise support the RFID functions of the reader. The communication module includes a transceiver that generates and transmits an RF interrogation signal to each tag via the antenna 30, and that receives a reflected RF payload signal generated by each tag via the antenna 30 in response to the interrogation signal. The antenna 30 is coupled to the RF communication module using RF transmission lines or RF coaxial cables in combination with suitable RF connectors, plugs, nodes, or terminals on the communication module and/or on the antenna.

The gun-shaped configuration of the reader sled 12 is merely exemplary, because the antenna 30 can be deployed in any number of different reader configurations. Also, the front deployment of the antenna in the radome 18 is merely exemplary, because the antenna 30 can be deployed at other locations on the sled, for example, on the top or the bottom of the sled 10, or in a dock on which the reader 10 is supported. In the exemplary application described herein, the antenna 30 is designed to operate in the UHF frequency band designated for RFID systems. Alternate embodiments may instead utilize the high frequency band, or the low frequency band, designated for RFID systems. For example, in the United States, RFID systems may utilize the 902-928 MHz frequency band, and in Europe, RFID systems may utilize the 865-868 MHz frequency band. The antenna 30 can be designed, configured, and tuned to accommodate the particular operating frequency band of the host RFID reader 10. In addition, the antenna 30 described herein can also be used in non-RFID applications.

Figure 2:
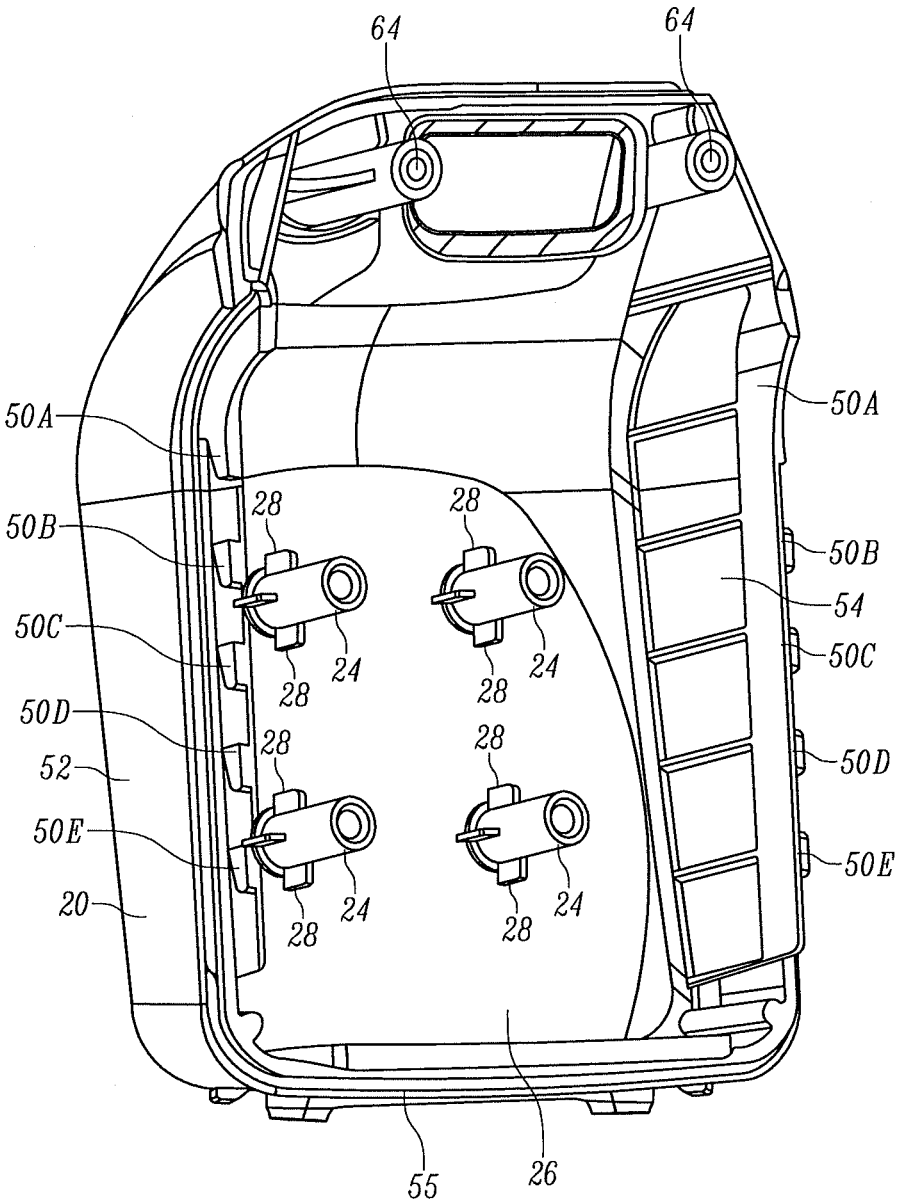
FIG. 2 is an enlarged, perspective view of a front housing of the radome of FIG. 1, and looking into the interior of the front housing prior to installation of a first printed circuit board of an antenna.
Figure 3:
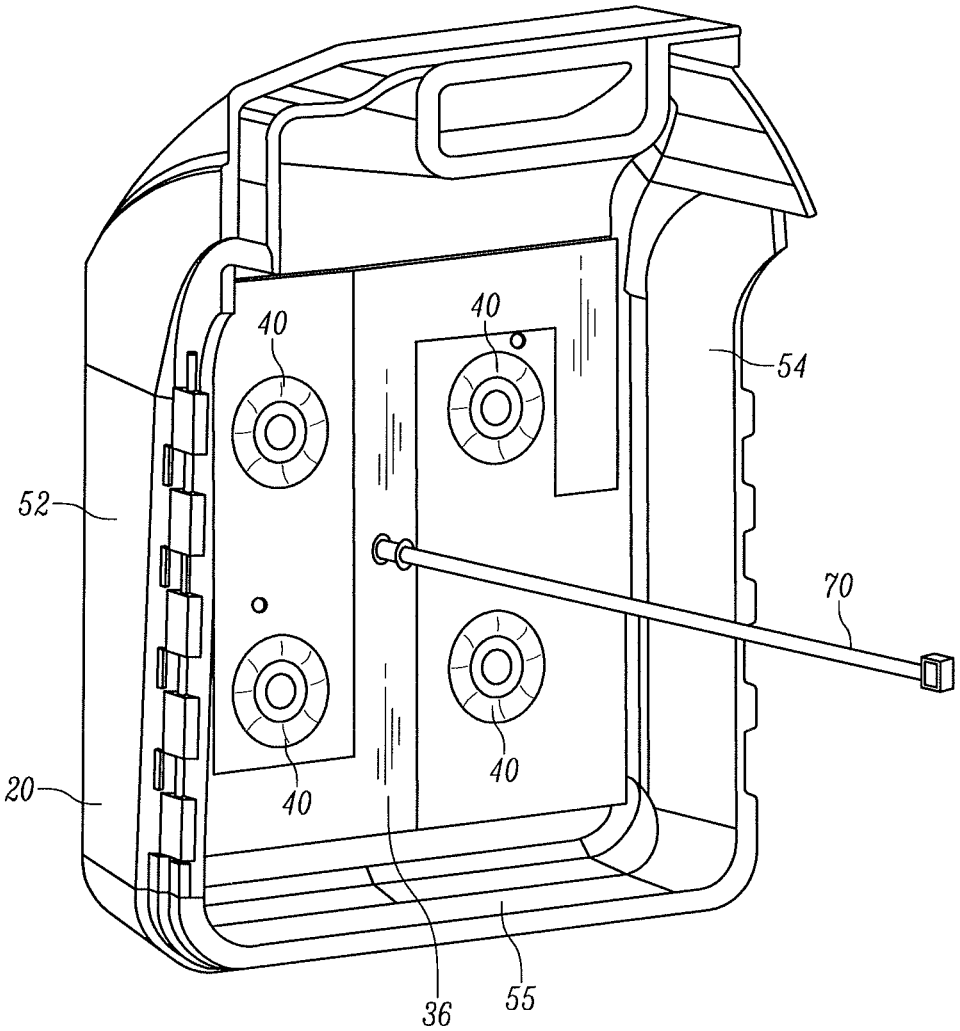
FIG. 3 is a view analogous to FIG. 2, after the first printed circuit board of the antenna has been installed.

As best shown in FIGS. 2-3, the front housing 20 is an injection-molded, high impact-resistant, generally cup-shaped part constituted of an electrically non-conductive material, such as a synthetic plastic material. A plurality of elongated first cylindrical posts 24 is integrally formed with a front wall 26 of the front housing 20. A plurality of first support projections 28 is integrally formed with each first post 24, extends radially of each first post 24, and is spaced circumferentially, preferably equiangularly, around each first post 24.

As described below, the antenna 30, in the preferred embodiment of FIG. 8, has a primary antenna member 32 and a secondary antenna member 34. The primary antenna member 32 is mounted on a dielectric substrate or first printed circuit board 36 (see FIG. 3). The secondary antenna member 34 is mounted on a dielectric substrate or second printed circuit board 38 (see FIG. 5).

Returning to FIGS. 2-3, the first board 36 has a plurality of holes through which the first posts 24 are inserted until a leading side of the first board 36 rests on top of the first support projections 28. Then, the exposed free ends of the first posts 24 are deformed, typically by being exposed to a heat or welding gun, to form enlarged, deformed heads 40 for engaging a trailing side of the first board 36, thereby heat-staking and locking the first board 36 against the first support projections 28.

Figure 4:
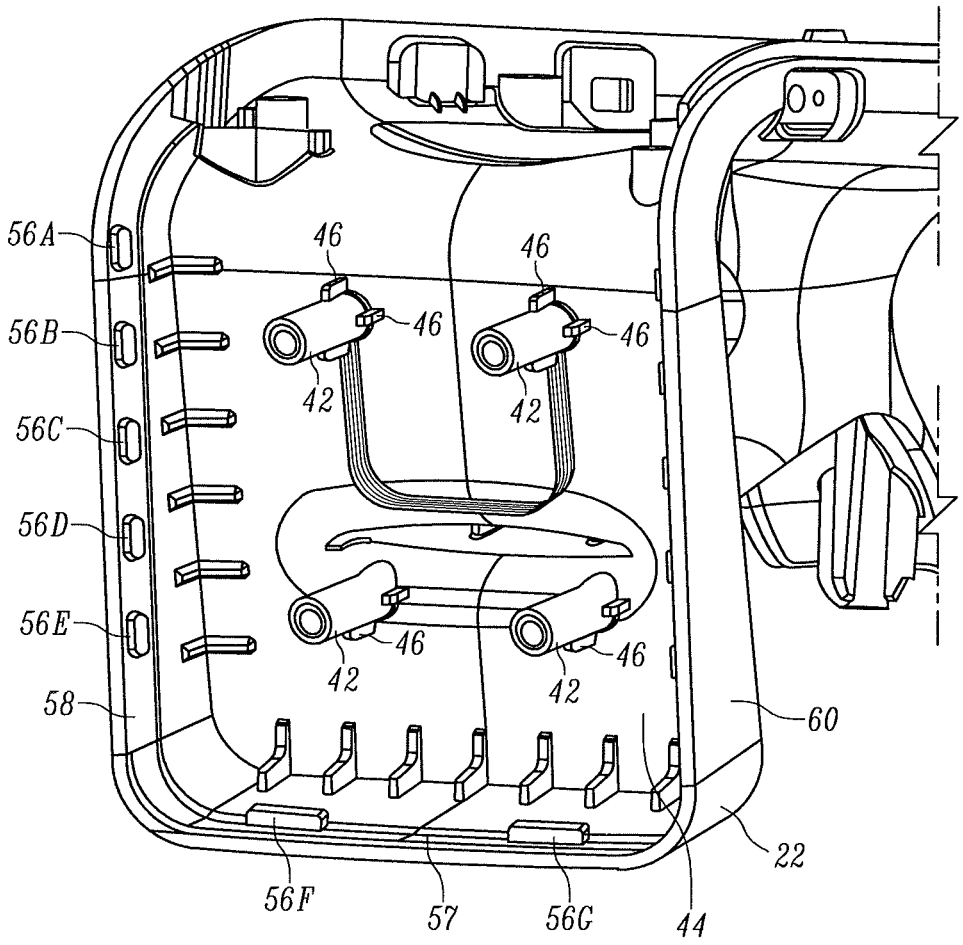
FIG. 4 is an enlarged, perspective view of a rear housing of the radome of FIG. 1, and looking into the interior of the rear housing prior to installation of a second printed circuit board of the antenna.
Figure 5:
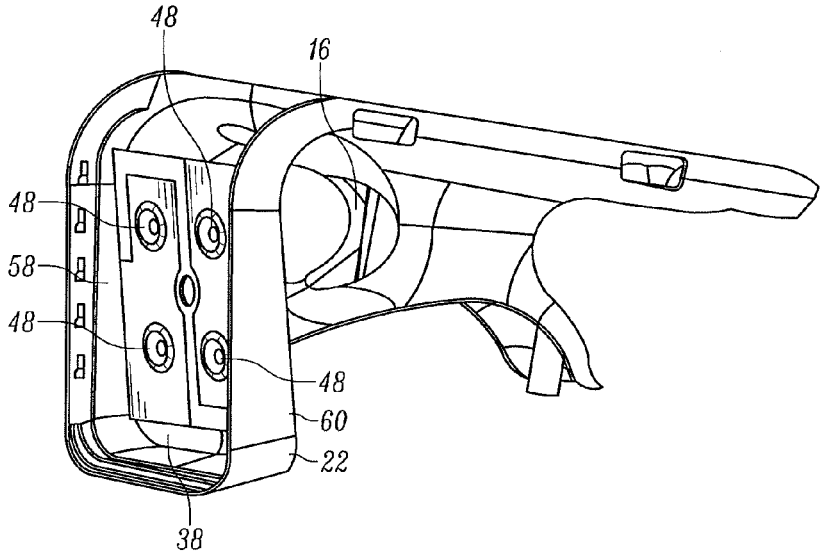
FIG. 5 is a view analogous to FIG. 4, after the second printed circuit board of the antenna has been installed.

Similarly, as best shown in FIGS. 4-5, the rear housing 22 is an injection-molded, high impact-resistant, generally cup-shaped part constituted of an electrically non-conductive material, such as a synthetic plastic material. A plurality of elongated second cylindrical posts 42 is integrally formed with a rear wall 44 of the rear housing 22. A plurality of second support projections 46 is integrally formed with each second post 42, extends radially of each second post 42, and is spaced circumferentially, preferably equiangularly, around each second post 42.

Figure 7:
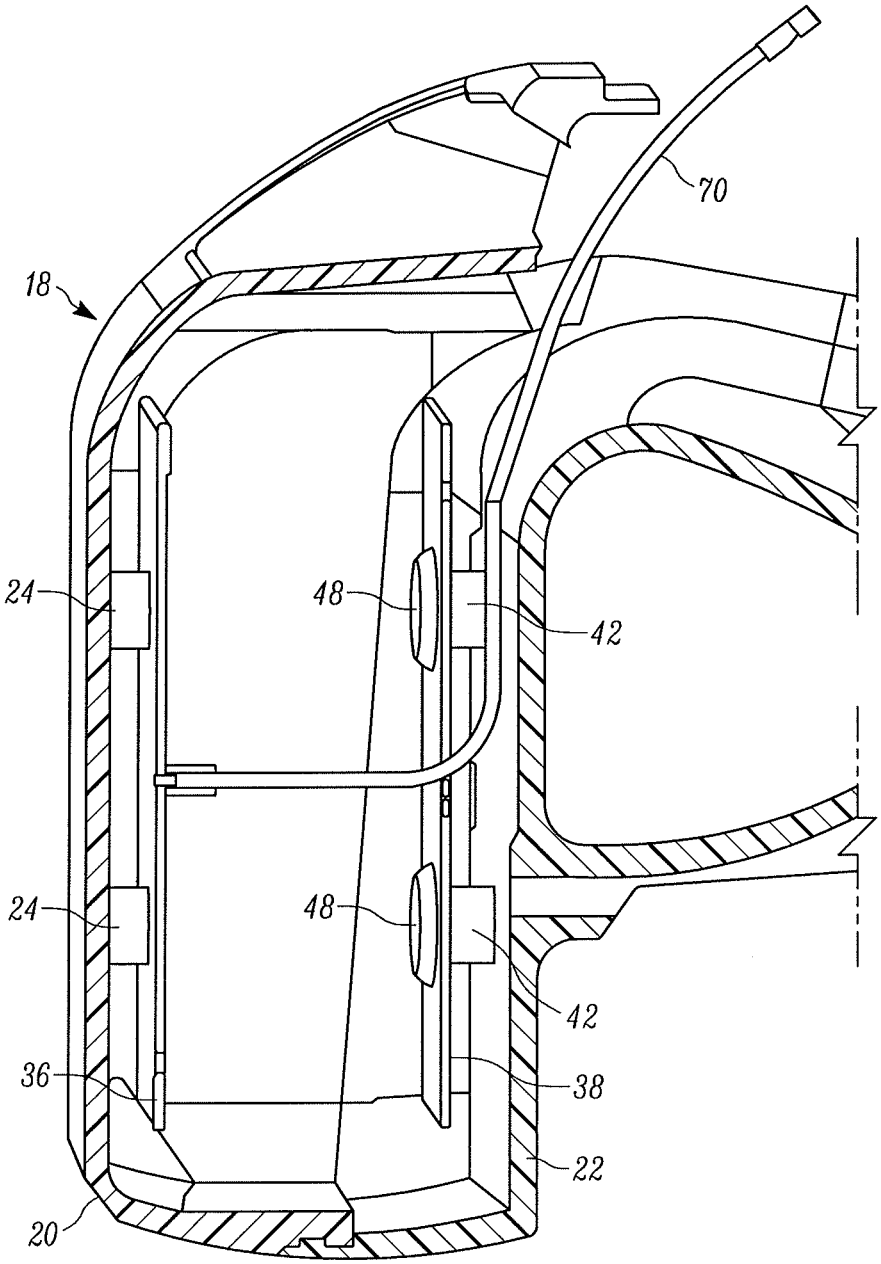
FIG. 7 is a view analogous to FIG. 6, and showing a pair of printed circuit boards of the antenna mounted inside the radome.

Similarly, the second board 38 has a plurality of holes through which the second posts 42 are inserted until a leading side of the second board 38 rests on top of the second support projections 46. Then, the exposed free ends of the second posts 42 are deformed, typically by being exposed to a heat or welding gun, to form enlarged, deformed heads 48 for engaging a trailing side of the second board 38, thereby heat-staking and locking the second board 38 against the second support projections 46. Thus, the posts 24, 42, the projections 28, 46, and the heads 40, 48 together constitute a support structure for holding the boards 36, 38 apart in mutual parallelism (see FIG. 7) and for supporting the antenna 30 in the radome 18.

Figure 9:
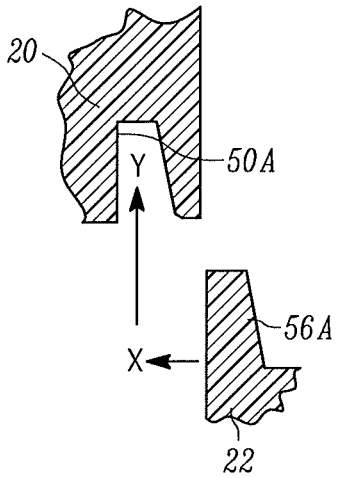
FIG. 9 is an enlarged, broken-away, sectional view depicting how the front and rear housings are connected to each other.

The front housing 20 is directly connected to, and bounds an interior with, the rear housing 22. More particularly, as best seen in FIG. 2, the front housing 20 has a plurality of electrically non-conductive, recesses or female fasteners 50A, 50B, 50C, 50D, 50E at both opposite side walls 52, 54 of the front housing 20. Additional female fasteners are advantageously provided on a bottom wall 55 of the front housing 20. As best seen in FIG. 4, the rear housing 22 has a plurality of electrically non-conductive, projections or male fasteners 56A, 56B, 56C, 56D, 56E at both opposite side walls 58, 60 of the rear housing 22. Additional male fasteners 56F, 56G are provided on a bottom wall 57 of the rear housing 22. The connection between the front and rear housings 20, 22 is made by first moving the male fasteners 56A, 56B, 56C, 56D, 56E into the female fasteners 50A, 50B, 50C, 50D, 50E in a first direction, and then by moving the male fasteners 56A, 56B, 56C, 56D, 56E in a second direction different from the first direction. As best seen in FIG. 9 for the representative male fastener 56A and the representative female fastener 50A, the male fastener 56A, advantageously having a tapered trapezoidal shape, is first generally moved in the horizontal direction X, and then generally moved in the vertical direction Y. Each female fasteners 50A, 50B, 50C, 50D, 50E has a complementary, tapered trapezoidal shape to receive the male fasteners by this dual-axis movement, thereby securing the housings 20, 22 together. In order to lock the housings 20, 22 together, the front housing 20 is provided with rearwardly-extending, threaded inserts 64 (see FIG. 2), advantageously configured of an electrically conductive material, and electrically conductive fasteners 66 (see FIG. 6) that threadedly engage the inserts 64.

Figure 6:
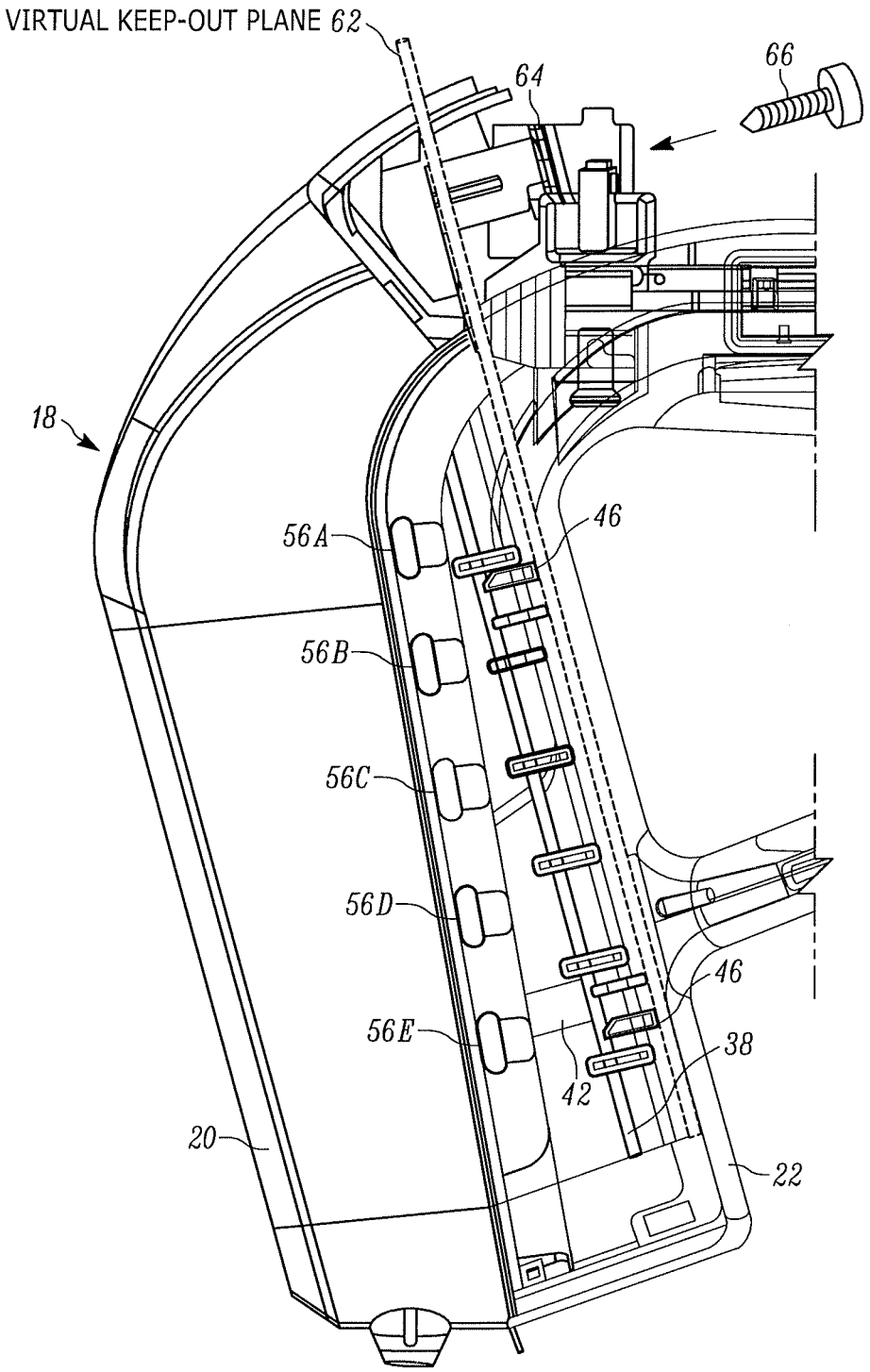
FIG. 6 is a broken-away, enlarged, side view of the radome of FIG. 1, and showing a virtual antenna keep-out plane and one of the printed circuit boards mounted inside the radome.

As best seen in FIG. 6, the antenna 30 is supported between the connected housings behind a virtual keep-out plane 62. There are no electrically conductive materials and/or electrically conductive fasteners in the housings or the support structure to the left of this plane 62, i.e., forwardly of the antenna 30. The electrically conductive inserts 64 and the electrically conductive fasteners 66 are located to the right of this plane 62, i.e., rearwardly of the antenna 30. Thus, the antenna 30 can transmit or receive RF signals forwardly through the connected housings 20, 22 during scanning without being detuned or being substantially attenuated.

Returning to FIG. 2, a seal 64 extends around a periphery of the front housing 20, and is fixed to the front housing 20 by being overmolded thereon. The seal 64 engages the rear housing 22 when the housings 20, 22 are connected for environmentally sealing the antenna 30 inside the connected housings. Advantageously, the seal 64 is constituted of a thermoplastic polyurethane (TPU) material.

Figure 8:
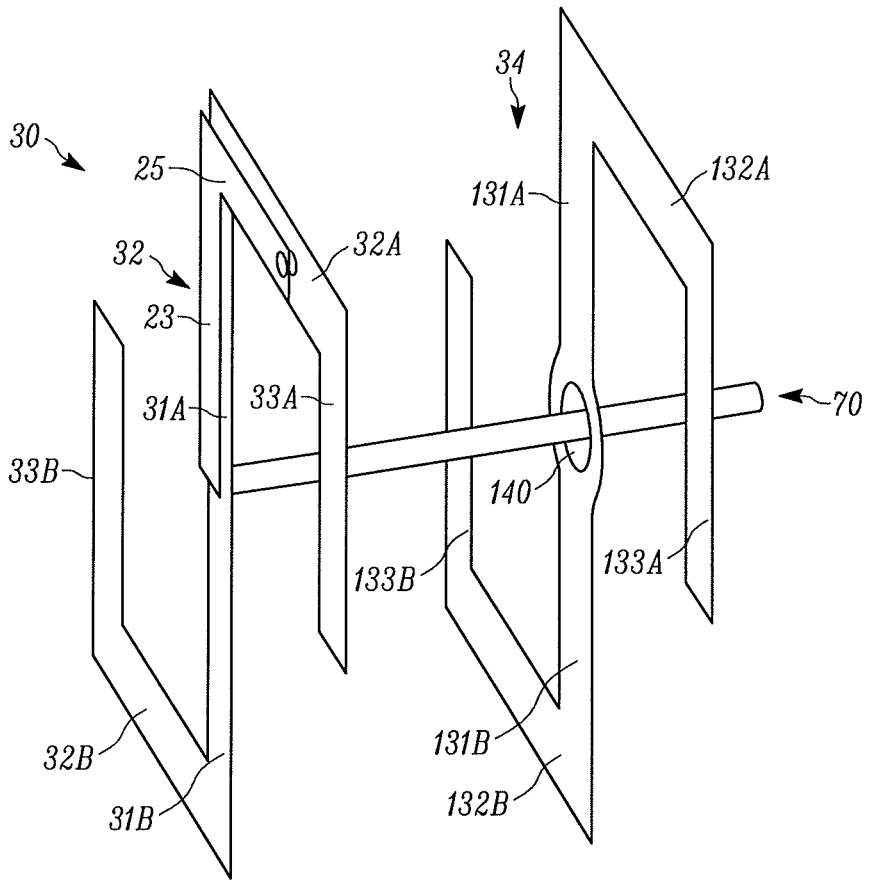
FIG. 8 is an enlarged, perspective view of the conductive elements of the antenna mounted inside the radome, but with the boards omitted for clarity.

Although different antenna embodiments may be employed, the antenna 30 depicted in FIG. 8 is currently preferred. The aforementioned primary antenna member 32 (on board 36) includes a first antenna element comprised of three, generally planar, electrically conductive, linear sections 31A, 32A, and 33A arranged in an end-to-end succession, one after another. Adjacent successive linear sections 31A and 32A are generally perpendicular to each other in a first turn. Adjacent successive linear sections 32A and 33A are generally perpendicular to each other in a second turn. Linear sections 31A and 33A are generally parallel to each other. The primary antenna member 32 also includes a second antenna element comprised of three, generally planar, electrically conductive, linear sections 31B, 32B, and 33B arranged in an end-to-end succession, one after another. Adjacent successive linear sections 31B and 32B are generally perpendicular to each other in a first turn. Adjacent successive linear sections 32B and 33B are generally perpendicular to each other in a second turn. Linear sections 31B and 33B are generally parallel to each other. Sections 31A and 31B are collinear and extend in opposite radial directions. Sections 32A and 32B are generally parallel to each other. The primary antenna member 32 generally has an S-shape. The primary antenna member 32 is a dipole operative for conducting an RF signal along the primary antenna member, and for transmitting and receiving electromagnetic waves with a primary slant polarization having components in both of two mutually orthogonal planes (e.g., horizontal and vertical polarization planes). Thus, the reader 10 is enabled to read any tag, no matter its orientation.

To increase the antenna gain, it is desirable to juxtapose the secondary antenna member 34 (on board 38) with the primary antenna member 32. The secondary antenna member 34 re-radiates the electromagnetic waves propagated by the primary antenna member 32 with a secondary slant polarization that is congruent to the primary slant polarization in a manner analogous to a Yagi antenna. Thus, the secondary antenna member 34 is likewise S-shaped and is spaced generally parallel to, and rearwardly of, the generally planar, S-shaped primary antenna member 32 by a spacing of about a quarter wavelength or less as measured at a center frequency in the operating band. The secondary antenna member 34 includes a first antenna element comprised of three, generally planar, electrically conductive, linear sections 131A, 132A, and 133A arranged in an end-to-end succession, one after another. Adjacent successive linear sections 131A and 132A are generally perpendicular to each other in a first turn. Adjacent successive linear sections 132A and 133A are generally perpendicular to each other in a second turn. Linear sections 131A and 133A are generally parallel to each other. The secondary antenna member 34 also includes a second antenna element comprised of three, generally planar, electrically conductive, linear sections 131B, 132B, and 133B arranged in an end-to-end succession, one after another. Adjacent successive linear sections 131B and 132B are generally perpendicular to each other in a first turn. Adjacent successive linear sections 132B and 133B are generally perpendicular to each other in a second turn. Linear sections 131B and 133B are generally parallel to each other. Sections 131A and 131B are collinear and extend in opposite radial directions. Sections 132A and 132B are generally parallel to each other.

The RF signal is fed to the antenna 30 by a feeding arrangement that includes a feed line 70 and an L-shaped, microstrip circuit having a linear section 23 that is juxtaposed with the linear section 31A of the primary antenna member 32, and a linear section 25 that is juxtaposed with the linear section 32A of the primary antenna member 32. The feed line 70 passes through the secondary antenna member 34 with a clearance 140 and is electrically isolated therefrom. The electrical length of the linear sections 23 and 25 is about a quarter of a wavelength or less at the center frequency of the operating band. To simplify the drawings, the microstrip circuit has been illustrated without its supporting dielectric substrate.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors, and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein, will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An antenna radome for protecting an antenna of a radio frequency (RF) identification (RFID) reader operative for scanning RFID tags, comprising:

a rear housing constituted of an electrically non-conductive material;

a front housing constituted of the electrically non-conductive material, the front housing being directly connected to, and bounding an interior with, the rear housing;

a support structure located in the interior of the connected housings for supporting the antenna in the interior to enable RF signals to be transmitted or received by the antenna forwardly through the connected housings during scanning without being detuned by electrically conductive materials and electrically conductive fasteners located forwardly of the antenna; and a seal between the connected housings for environmentally sealing the antenna inside the connected housings.

2. The radome of claim 1, wherein one of the housings has a plurality of electrically non-conductive, female fasteners, and wherein the other of the housings has a corresponding plurality of electrically non-conductive, male fasteners that are moved into the female fasteners in a first direction, and are then secured to the female fasteners by moving the male fasteners in a second direction different from the first direction.

3. The radome of claim 1, wherein the material of each housing is a synthetic plastic material.

4. The radome of claim 1, wherein the support structure includes a plurality of elongated posts integral with the housings.

5. The radome of claim 1, wherein the antenna includes a pair of first and second printed circuit boards, and wherein the support structure includes a plurality of elongated first posts extending through the first board, and a plurality of elongated second posts extending through the second board.

6. The radome of claim 5, wherein the support structure includes a plurality of first support projections spaced circumferentially around each first post and engaging and supporting the first board, and wherein the support structure includes a plurality of second support projections spaced circumferentially around each second post and engaging and supporting the second board.

7. The radome of claim 6, wherein each post has an enlarged, deformed head for engaging and locking a respective board on the respective support projections.

8. The radome of claim 5, wherein the support structure holds the boards apart in mutual parallelism.

9. The radome of claim 1, wherein the seal is constituted of a thermoplastic polyurethane material, extends around a periphery of one of the housings, and is fixed to the one housing.

10. An antenna radome for protecting an antenna of a handheld radio frequency (RF) identification (RFID) reader operative for scanning RFID tags, comprising:

a rear housing and a front housing, each constituted of an electrically non-conductive material, one of the housings having a plurality of electrically non-conductive, female fasteners, and the other of the housings having a corresponding plurality of electrically non-conductive, male fasteners that are moved into the female fasteners in a first direction, and are then locked to the female fasteners by moving the male fasteners in a second direction different from the first direction, the front housing being directly connected to, and bounding an interior with, the rear housing;

a support structure located in the interior of the connected housings for supporting the antenna in the interior to enable RF signals to be transmitted or received by the antenna forwardly through the connected housings during scanning without being detuned by electrically conductive materials and electrically conductive fasteners located forwardly of the antenna; and a seal between the connected housings for environmentally sealing the antenna inside the connected housings, the seal being fixed to, and extending around a periphery of, one of the housings.

11. A method of installing an antenna in a radome for use with a radio frequency (RF) identification (RFID) reader operative for scanning RFID tags, comprising:

mounting the antenna in an interior between a rear housing and a front housing, each housing being formed from an electrically non-conductive material;

directly connecting the housings together;

supporting the antenna in the interior to enable RF signals to be transmitted or received by the antenna forwardly through the connected housings during scanning without being detuned by electrically conductive materials and electrically conductive fasteners located forwardly of the antenna; and environmentally sealing the antenna inside the connected housings.

12. The method of claim 11, wherein the connecting is performed by configuring one of the housings with a plurality of electrically non-conductive, female fasteners, by configuring the other of the housings with a corresponding plurality of electrically non-conductive, male fasteners, by moving the male fasteners into the female fasteners in a first direction, and by then moving the male fasteners in a second direction different from the first direction to secure the housings together.

13. The method of claim 11, and configuring the material of each housing with a synthetic plastic material.

14. The method of claim 11, wherein the supporting is performed by integrally forming a plurality of elongated posts with the housings.

15. The method of claim 11, and configuring the antenna with a pair of first and second printed circuit boards, and wherein the supporting is performed by passing a plurality of elongated first posts through the first board, and by passing a plurality of elongated second posts through the second board.

16. The method of claim 15, wherein the supporting is performed by spacing a plurality of first support projections circumferentially around each first post, by spacing a plurality of second support projections circumferentially around each second post, by engaging and supporting the first board with the first support projections, and by engaging and supporting the second board with the second support projections.

17. The method of claim 16, wherein the supporting is performed by deforming an end of each post to form an enlarged head for engaging and locking a respective board on the respective support projections.

18. The method of claim 15, wherein the supporting is performed by holding the boards apart in mutual parallelism.

19. The method of claim 11, wherein the sealing is performed by fixing a seal to one of the housings, and by extending the seal around a periphery of the one housing.

* * * * *